US007201281B1

(12) United States Patent
Welker

(10) Patent No.: US 7,201,281 B1
(45) Date of Patent: Apr. 10, 2007

(54) ADJUSTABLE MODULAR MERCHANDISE PUSHER SYSTEM

(75) Inventor: Brian Hart Welker, Pfafftown, NC (US)

(73) Assignee: Imageworks Display and Marketing Group, Winston-Salem, NC (US)

( * ) Notice: Subject to any disclaimer, the term of this patent is extended or adjusted under 35 U.S.C. 154(b) by 280 days.

(21) Appl. No.: 10/739,768

(22) Filed: Dec. 18, 2003

(51) Int. Cl.
*A47F 7/00* (2006.01)

(52) U.S. Cl. ..... 211/59.3

(58) Field of Classification Search ..... 211/59.3, 211/59.2, 59.4, 51, 184
See application file for complete search history.

(56) References Cited

U.S. PATENT DOCUMENTS 4,762,235 A * 8/1988 Howard et al. ..... 211/59.3
4,762,236 A 8/1988 Jackle, III et al.
4,830,201 A 5/1989 Breslow
5,351,839 A 10/1994 Beeler et al.
5,634,564 A 6/1997 Spamer et al.
5,665,304 A * 9/1997 Heinen et al. ..... 312/71
5,682,824 A 11/1997 Visk
5,839,588 A 11/1998 Hawkinson
6,305,559 B1 10/2001 Hardy
6,484,891 B2 11/2002 Burke
6,769,552 B1 * 8/2004 Thalenfeld ..... 211/59.3
6,830,157 B2 * 12/2004 Robertson et al. ..... 211/59.3
6,889,854 B2 * 5/2005 Burke ..... 211/59.3
6,923,330 B1 * 8/2005 Nagel ..... 211/59.3

OTHER PUBLICATIONS mtm modular pusher system—Imageworks Display & Marketing Group-pack pusher & carton pusher shelf components, 2 pages.
Shelf Management by Design—SHELF Works (TM)—Trion -9 pages.
FFR Yellow Pages—2003 Product Catalog—3 pages.
Power Zone (TM) Shelf-facing System—FFR—4 pages.

* cited by examiner

*Primary Examiner*—Sarah Purol

(57) ABSTRACT

A modular pusher system for use with articles of merchandise in a display includes pusher tracks and dividers, each of which include detachable sections so that these basic components can be used in pusher systems of different depths. Spring loaded pushers are mounted on the tracks, and both the tracks and the dividers can be snap fit into slots in front and rear extrusions that can be mounted on a shelf. The tracks and the dividers include notches and cut-out sections which define auxiliary latching mechanisms intermediate the ends thereof, which can be snapped into the rear extrusion when rear sections are detached.

15 Claims, 7 Drawing Sheets

34
36
38
42
44
46
48
50
52
54
55
57

ADJUSTABLE MODULAR MERCHANDISE PUSHER SYSTEM

BACKGROUND OF THE INVENTION

1. Field of the Invention

A merchandising display assembly according to this invention includes spring loaded pushers for advancing articles toward the front of the display as articles or merchandise is removed by a prospective purchaser. The assembly can be adjusted for use on display shelves of different depth.

2. Description of the Prior Art

One prior art modular pusher system shown in FIGS. 1 and 2 includes the following components: a series of spring loaded pusher assemblies 30A, a front strip 12 in the form of a clear extrusion including channels in which advertising and graphic material 5 can be mounted, a rear strip 22 in the form of a second extrusion, and a series of shelf dividers 70A separating adjacent pusher assemblies. The front and rear strips are mounted respectively along the front and rear of a merchandising shelf 6. These strips can be mounted, in a parallel relationship, on a shelf with the use of double-sided adhesive tape. Articles of merchandise 2 can be stacked side by side with multiple articles in each of several rows. Both the pusher assemblies and the shelf dividers include snap features on opposite ends so that both can be snapped into the front and rear mounting strips. Each pusher assembly includes a pair of side by side horizontal rails with an upright pusher mounted on these rails. One end of a spring is attached to each pusher and the opposite end is attached at the front of the corresponding rail subassembly so that the pusher urges product located in front of the pusher toward the front of the shelf. The spring extends between the parallel rails and coils behind the pusher as the pusher advances toward the front of the shelf. Vertical tabs extend from the front end of both the pusher rails and the shelf dividers. The vertical tabs on both members can be snapped into an upwardly open slot on the front strip 12. Extruded fingers in this slot grip the tabs when they are inserted from above. The rear extruded strip 22 also includes a slot with gripping fingers, but this rear slot is horizontal and faces forward. A portion of the rear strip, through which the rear slot extends is elevated relative to the shelf so that the rails will be sloped toward the front of the assembly. A latching protrusion on the dividers 70A is similarly offset so that lips on opposites sides of the divider base will be parallel to the shelf when mounted between the front and rear strips. Both the pusher rails and the dividers have the same length so that the depth of this assembly remains constant. However, this prior art assembly cannot be adjusted so that the same components can be used on shelves with different depths. This limits the versatility of this pusher assembly because the depth of shelves need not be constant and can vary from one merchandising display 4 to another. A standard size assembly may therefore be unsuited for some installations because the length of the pusher subassemblies and the dividers is too great for use with particular shelves. Alternatively, display space may be wasted where the depth of the shelves is greater than the length of the pusher assembly components.

SUMMARY OF THE INVENTION

A modular pusher system according to this invention is for use with articles of merchandise located on a shelf. This system includes a front member and a rear member mountable on the shelf in spaced relationship to each other. Also at least one pusher subassembly includes a pusher support slidable along a pusher track. The pusher track extends between the front and rear member and can be attached thereto at opposite ends of the pusher track. The system also includes dividers adjacent one side of each pusher subassembly. Each divider can be attached to the front and rear members at front and rear ends of each divider. Each divider includes a primary latching mechanism on the rear end thereof matable with the rear member, and at least one secondary latching mechanism located intermediate the front and rear ends of each divider. The secondary latching mechanism can be attached to the rear member when a portion of the divider between the secondary latching mechanism and the rear end of the divider is detached from the divider. This system can be employed for stacked article displays having different depths or articles of the same size to increase volume.

The pusher apparatus according to this invention advances articles of merchandise stacked in a row on a shelf as articles at the front of the row are sequentially removed. Articles are then always located at the front of a shelf for removal by prospective purchasers. The pusher apparatus includes a one piece molded track including rails flanking a groove extending from a front end to a rear end of the track. The track includes a front projection and a rear projection. The front and rear projections snap the molded track into engagement with front and rear mounting members mountable on the shelf. An upright pusher support slides along the track and engages the rear article of merchandise. At opposite ends a coil spring engages the pusher support and the molded track. The coil spring is positioned to urge the pusher support toward the front end of the track. The pusher apparatus includes a cut-out section in the groove and a notch, both located at an intermediate position between the front end and rear end of the track. The notch weakens the track at the intermediate position for detachment of a portion of the track, and the cut-out is positioned relative to the notch so that remaining portions of the rails extend beyond the groove when the track is broken at the notch. The remaining rail portions are used to secure the pusher apparatus on the shelf when the pusher apparatus is shortened.

Divider members used in this assembly comprise a molded one piece upright member including a flat wall extending upwardly from a lip extending along a lower edge of the divider member. A front tab is located at a front end of the divider. The front tab extends vertically relative to a horizontally extending lip. The lip is offset adjacent to the front tab to provide clearance for insertion of the front tab into a front mounting slot on a separate front mounting member. A rear tab is located at a rear end of the divider. The rear tab extends parallel to the lip and is offset vertically relative to the lip to provide clearance for insertion of the rear tab into a rear mounting slot on a separate rear mounting member. A secondary tab is located intermediate the front and rear ends of the divider wall, and this secondary tab can be attached to the separate rear mounting member when the portion of the divider between the primary and secondary tabs is detached.

DETAILED DESCRIPTION OF THE DRAWINGS

Figure 3:
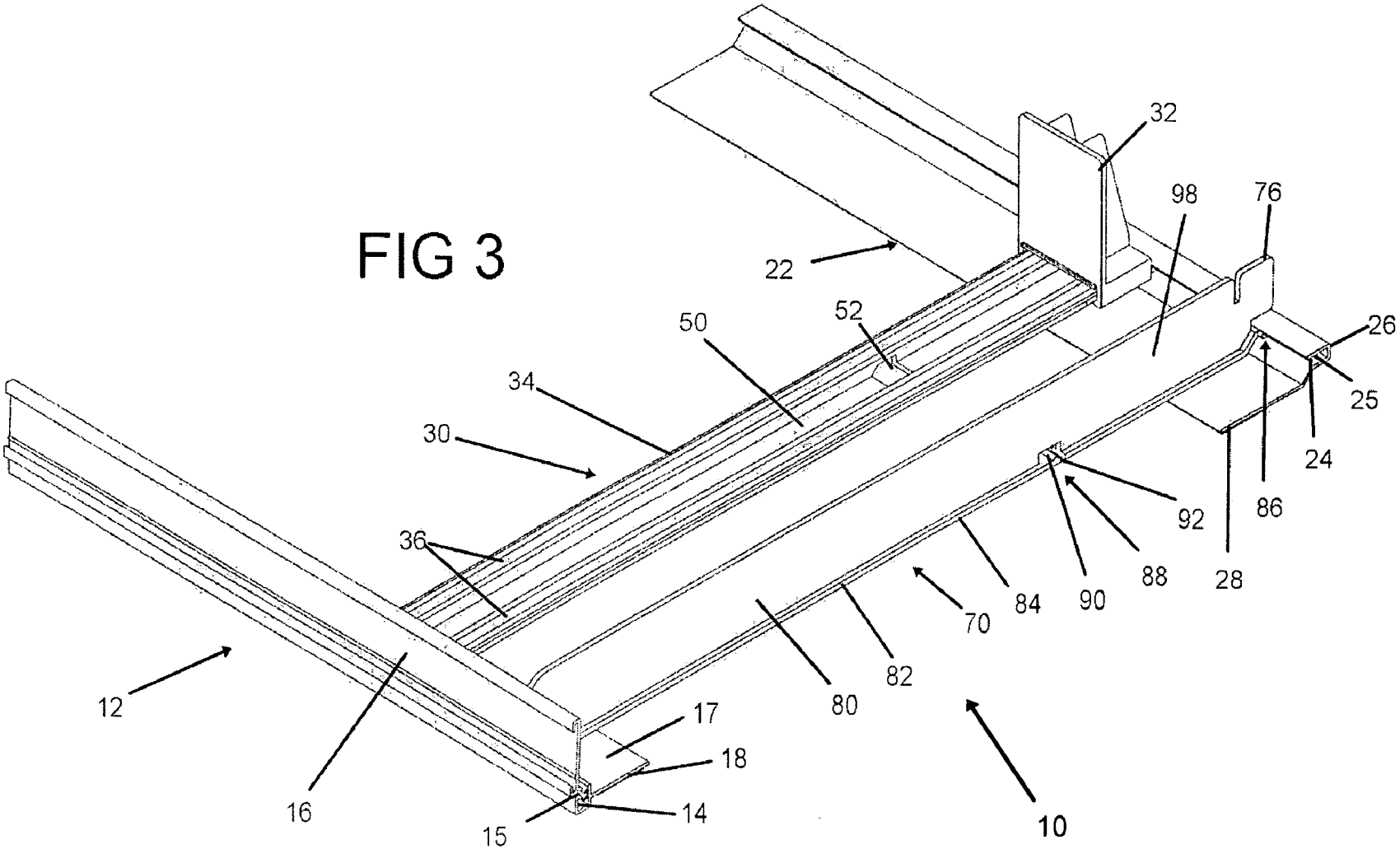
FIG. 3 is a view of the basic components of the current invention, shown in an assembled configuration. Additional pusher subassemblies and dividers would typically be employed in a configuration similar to that shown in FIG. 2.

The modular pusher system 10, shown in FIG. 3 is suited for use in either of two sizes. The larger version, shown in FIG. 3 has a greater depth and more articles 2 can be stored in each side by side row. The same components, as modified can also be used in a smaller version in which fewer articles are stacked or in which the shelf 6 on which the modular pusher system 10 would be used has less depth and cannot accommodate the larger version shown in FIG. 3. Pusher tracks 30 and the dividers 70 each include detachable portions at their rear, and secondary or auxiliary latches are located at an intermediate position for use in the smaller configuration. For the smaller configuration, a rear mounting strip 22 will be closer to a front mounting strip 12, than in the configuration shown in FIG. 3. In one particular embodiment, the depth of the track subassembly 30 and the dividers 70 would be 17 inches in the larger configuration and this dimension would be 12 inches in the smaller version. It should be understood, however, that modular pusher assemblies can be constructed in other sizes. It should also be understood that more than one detachable section and more than one auxiliary rear latching mechanism could be employed on both the pusher track 30 and the dividers 70 so that the same components, as modified could be used for more than two display sizes or shelf depths.

The adjustable modular pusher systems 10 according to this invention would employ both a front mounting member 12 and rear mounting member 22. Both of these mounting members 12 and 22 have a constant cross sectional configuration in the preferred embodiment of this invention, and can be easily fabricated as plastic extrusions. The front mounting strip or extrusion 12 includes an upwardly facing, vertical slot 14 extending between opposite ends of the mounting strip 12. Two rows of continuous fingers 15 extend partially into the slot 14 and these fingers can be deformed when mounting tabs 46 on the tracks 34 and 74 on the dividers 70 are inserted into the slot 14 at various positions between opposite ends of the mounting strip 12. The front mounting strip 12 also includes a channel 16 into which advertising material or pricing information can be inserted. A ledge 17 extends below the slot 14 towards the rear of the modular pusher assembly 10, and a double sided adhesive tape 18 can be used to mount the front strip 12 along the front edge of a shelf. A rear mounting strip 22 can be mounted near the rear of the same shelf in parallel relationship to the front mounting strip 12. Rear mounting strip 22 also has a continuous cross sectional configuration and can also be formed as a plastic extrusion. Front and rear extrusions 12 and 22 can be cut to length to fit a particular installation. Rear mounting extrusion 22 includes a forwardly facing, horizontal slot 25 extending between opposite ends. Curved fingers 25 extend into horizontal slot 24 to grip rear horizontal tabs 48 and 78 on the pusher tracks 34 and the dividers 70 respectively. A double sided adhesive tape 28 is also used to mount the rear mounting strip or extrusion 22 to the same shelf on which the front strip 12 is similarly mounted.

Figures 4, 5, 6, 7, 8, 9:
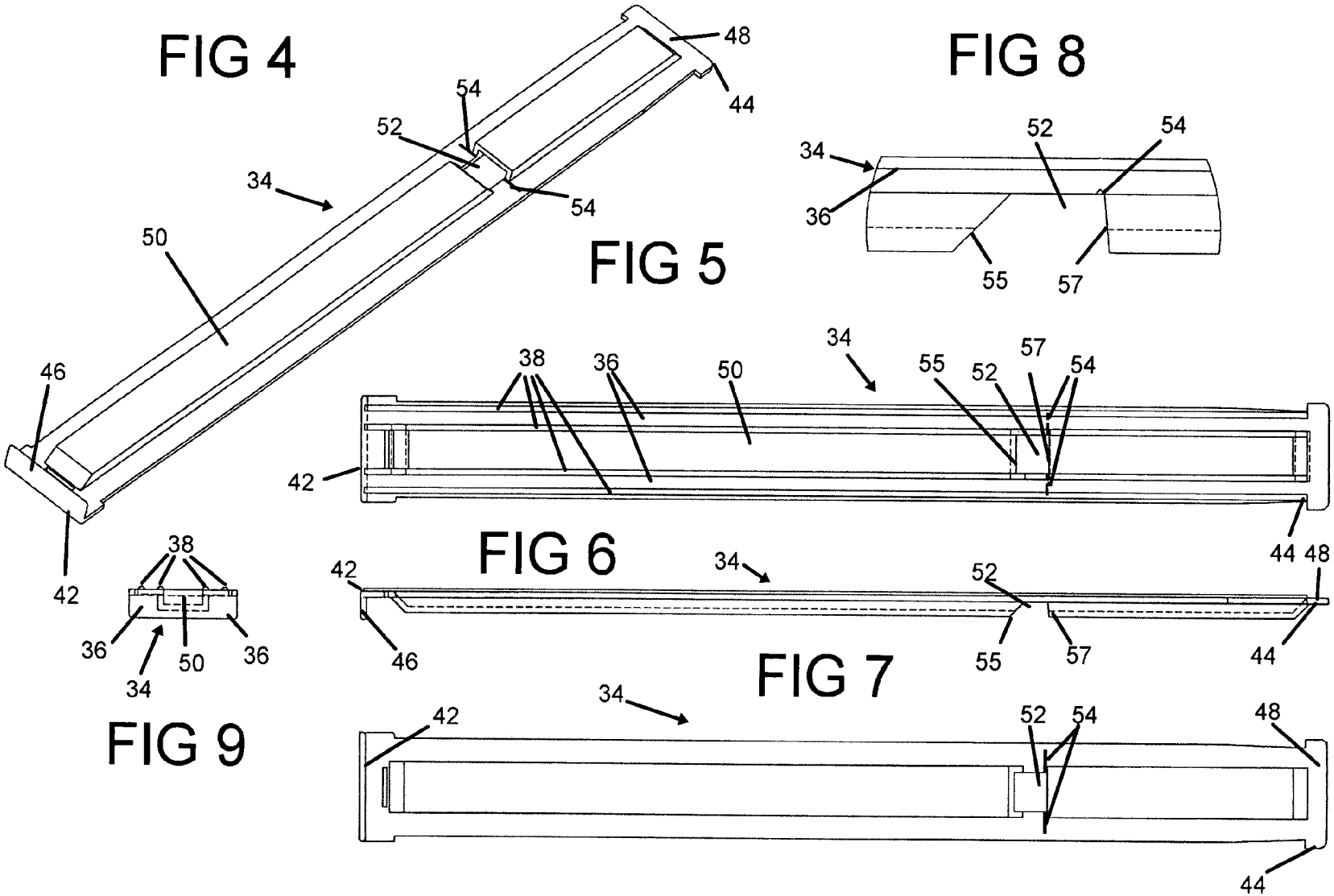
FIG. 4 is a three dimensional view showing the lower surface of a single pusher track.
FIG. 5 is a top plan view of the track shown in FIG. 4.
FIG. 6 is a side view of the track shown in FIGS. 4 and 5.
FIG. 7 is bottom plan view of the track shown in FIGS. 4–6.
FIG. 8 is a detail view of a cut-out section of the track shown in FIGS. 4–7.
FIG. 9 is a front end view of the track shown in FIGS. 4–7.

FIGS. 4–9 show various details of a single pusher track 34, which can be mounted between the front mounting strip 12 and the rear mounting strip 22. Preferably each pusher track 34 comprises a one piece, injection molded plastic member. Each pusher track 34 includes two elevated side rails 36 on opposite sides of a recessed groove 50. The rails 36 extend from front end 42 to the rear end 44 of the pusher track 34. A pair of radiused parallel ridges 38 extends from the top of the both of the side rails 36. The track 30 will support the articles of merchandise 2, and these radiused ridges 38 will directly engage the articles 2 resulting in only a small frictional force and minimal tendency that any of the articles 2 may become snagged preventing its advance toward the front of the display when a customer removes the front article in a particular row. A front tab 46 extends generally perpendicular to the upper surface of the track rails 38 downwardly in front of the front portion of the groove 50 as can be seen in FIG. 6. A clearance space is formed immediately aft of the front tab 46 so that the front tab 46 can be inserted into the upwardly open mounting slot 14 on the front mounting strip 12. The mounting tab 46 has a radiused distal end so that the slot fingers 15 will securely grip the mounting tab 46 when the pusher track 34 is attached to the front mounting strip 12. A flat horizontal strip 48 is located at the rear end 44 of the pusher track 34, and the tabs 48 on individual pusher tracks 34 can be inserted from the front into rear horizontal mounting slot 24. Normally the rear tab 48 will first be inserted into slot 24 after which the front portion of the pusher track 34 can be rotated into position so that front tab 46 can be inserted into slot 14 from above. The groove 50 ends in front of rear tab 48 so that there will be sufficient clearance for insertion of rear tab 48 into slot 24. The rear tab 48 serves as a primary latching mechanism for mounting the pusher track 34 on the rear mounting member 22.

According to this invention, the pusher track 34 also includes a cut-out 52 in the groove 50 and notches 54 on the lower surface of both side rails 36. The portion of the track 34 between the notches 54 and the rear track end 44 can be detached by snapping the track at the notches 54, which extend partially through both rails 36. Since the notches 54 form a weakened section the track will always be broken at this point. The cut-out 52 extends through the groove 50 for a short length in front of the notches 54. This cut-out 52 leaves only the side rails 36 connecting the front and rear sections of the track 34 on opposite sides of the cut-out 52, and except for the small rail ridges 38, the side rails 36 comprise thin sections in the same plane at this location. It is therefore easy to snap the track into two pieces, the front piece being used for the shorter version of the adjustable modular pusher system. The cut-out has inclined front edges 55, which are sloped at a greater angle than the rear cut-out edges 57. These rear edges are substantially aligned with the notches 54. A portion of both rails 36 remain after the track is broken at the notches 54. The sloped surface 55 merges with this remaining section of the side rails 36 to form a clearance, so that the remaining rail sections will fit within the forwardly facing slot 24 in the rear mounting strip 22. Since the fingers 25 in the slot 24 are flexible, these remaining portions of the rails can be inserted and the fingers 25 will deform even though the small rail ridges 38 on the remaining rail section will also be inserted into the slot 24. The fit between the rails 36 and the slot 24 will be tight enough to secure the pusher track 34 in place when the smaller and shorter version of the modular pusher system is installed.

Figure 10:
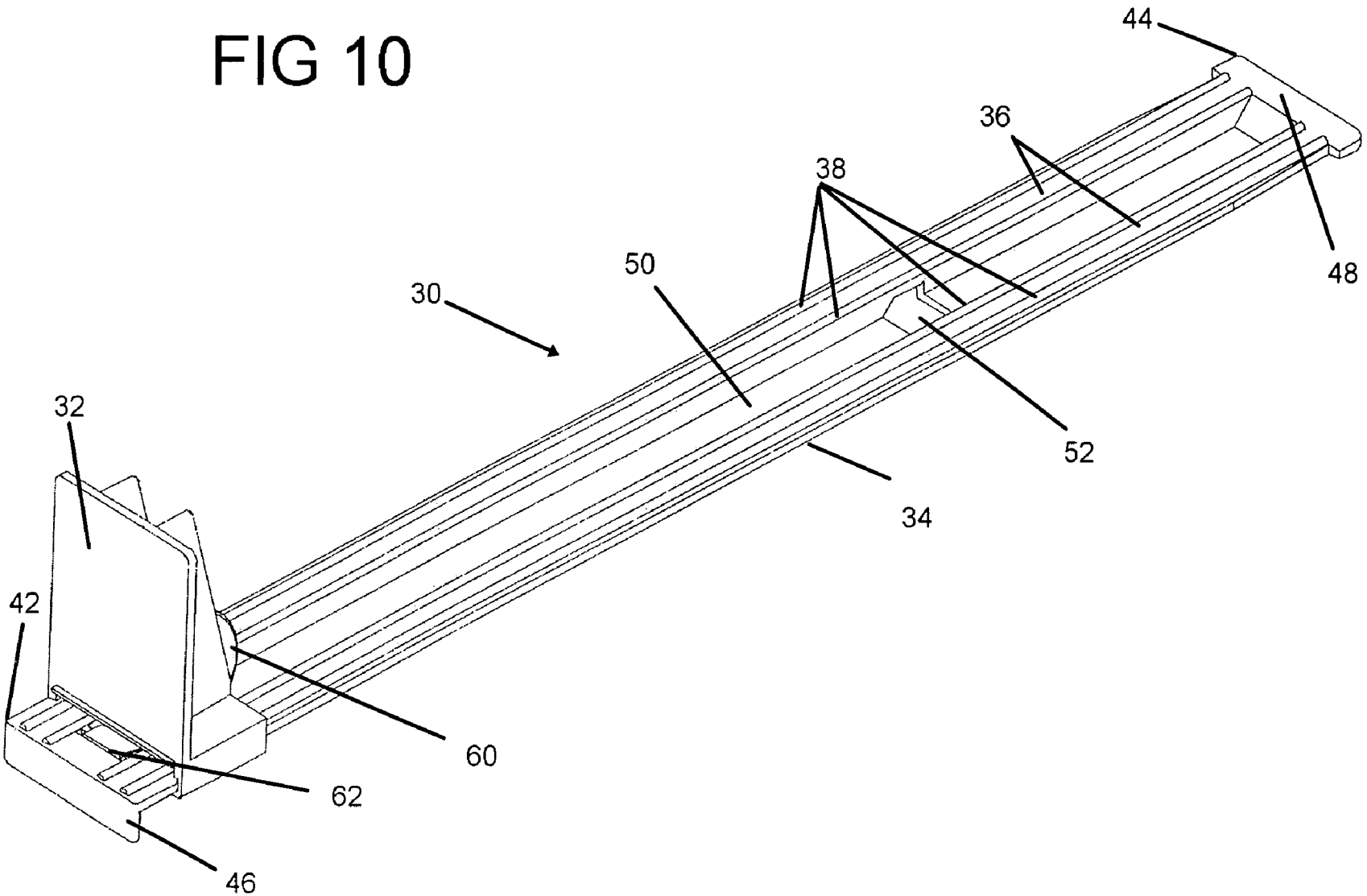
FIG. 10 is a three dimensional view of the pusher track subassembly viewed from the front of the track, and showing the front face of a pusher or pusher support member.
Figure 11:
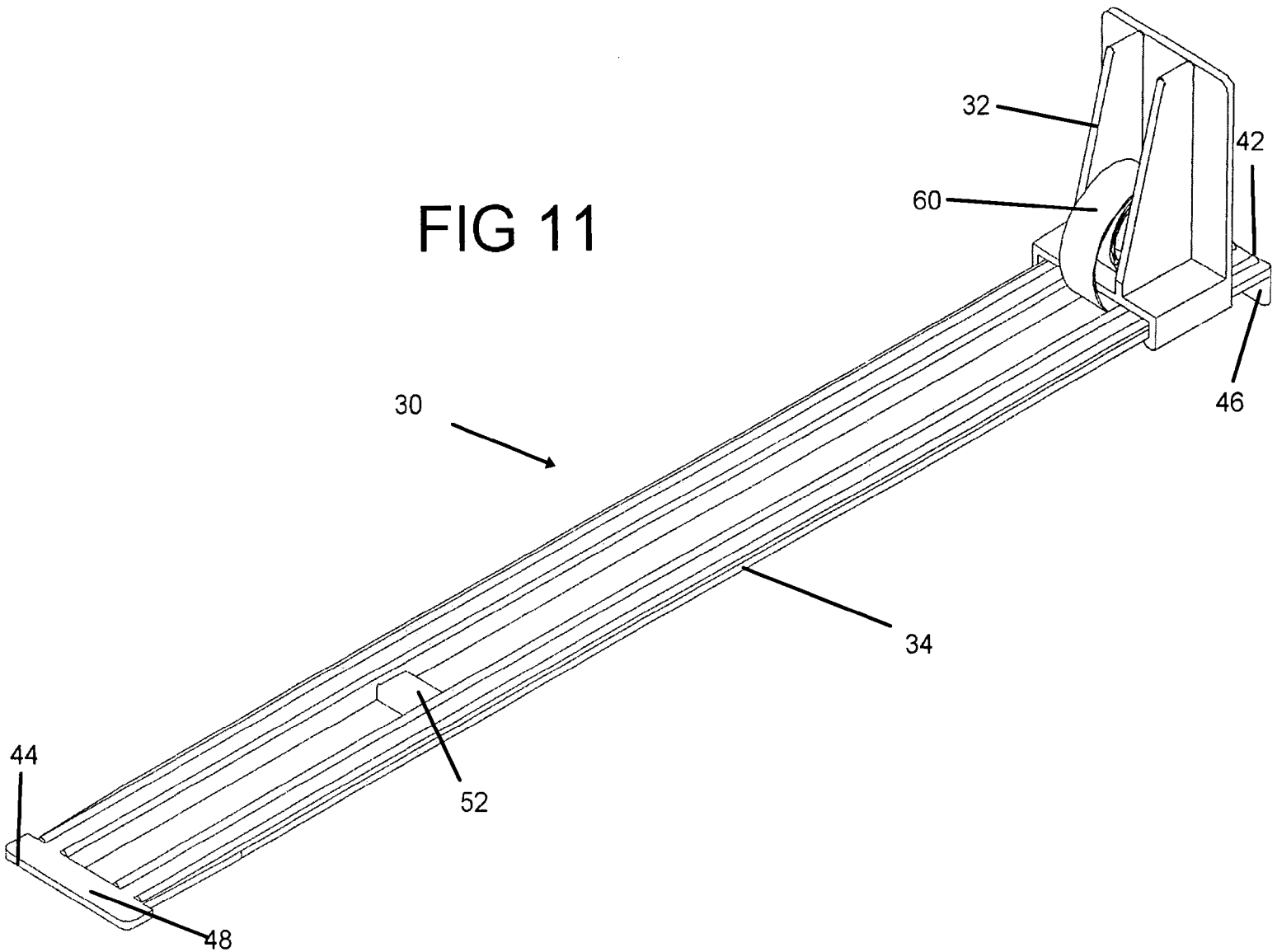
FIG. 11 is also a three dimensional view of the pusher track subassembly, here viewed from the rear, showing a coil spring attached at opposite ends to the track and the pusher.
Figure 12:
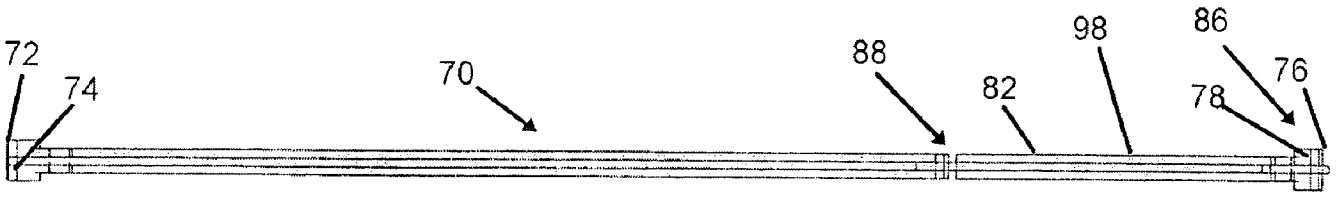
FIG. 12 is a top plan view of a divider of the type shown in FIG. 3.

FIGS. 10 and 11 show the manner in which the pusher 32 is mounted on the longer version of the pusher track 34. In each of these two schematics, the pusher 34 is located at its forwardmost position adjacent the front track end 42. This corresponds to the position they would occupy when all articles 2 have been removed from that article row. Each pusher 32 is a one-piece injection molded member and comprises an upright member that supports the rear of a stack of articles 2. The front face of each pusher 32 is flat and two C-shaped clamps that straddle the side rails 36 of track 34. The pusher 32 is free to slide between the front and back of the track 34, but the pusher 32 is spring biased relative to the track 34 by a coil spring 60, best seen in FIG. 11. The front spring end 62 is attached to the track 34 adjacent front track end 42. In the preferred embodiment, the front end of the coil spring 60 is bent and is inserted into a slot in the track 34. The coil spring 60 then extends beneath the front pusher plate and between the two C-shaped clamps. The coil spring 60 extends into the groove 50, which provides sufficient clearance for the coil spring 60 at a position along the track 34. The spring 60 is coiled behind the face of the pusher 32 as best shown in FIG. 11. This coil is maintained between two upright walls, which extend perpendicular to the front pusher face so the spring coil is trapped in a pocket formed by these three walls. As the pusher is drawn toward the rear track end 44, the spring partially uncoils with the uncoiled portion being received within groove 50. Since the coil spring 60 is longer than the track 34, a coiled end will remain in engagement with the pusher 32 and the spring 60 will always urge the pusher 32, and articles 2 in front of the pusher 32, toward the front track end 42 and toward the front of the product display and storage area. Since the face of the front mounting strip 12 is high enough to engage the front article 2, the stack of articles will be trapped between the spring loaded pusher 32 and the front mounting strip 12 with the entire stack being continuously urged forward. Detachment of the portion of the track behind the cut-out 52 and notch 54 will not interfere with the movement of the pusher 32. Even though removal of this rear section can possible permit the pusher 32 to slide off the rear of the shortened track 34, the coil spring 60 will tend to retain the pusher 32 on the track 34, and even if the pusher 32 is dislodged from the track 34, it will be a relatively simple matter to reattach the pusher 32 to the track 34.

Figure 13:
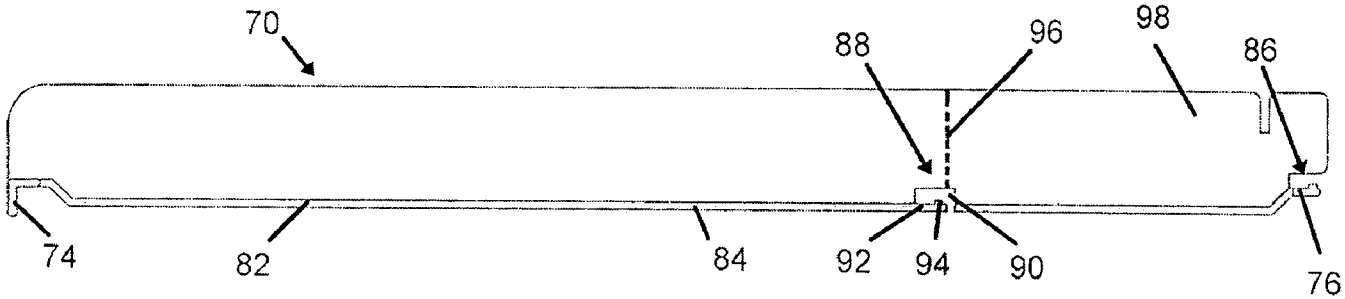
FIG. 13 is a side view of the divider shown in FIG. 12.
Figure 14:
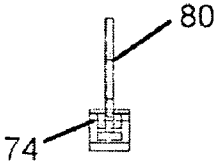
FIG. 14 is a front end view of the divider shown in FIGS. 12 and 13.
Figure 15:
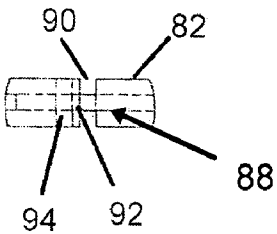
FIG. 15 is a detail view of the secondary latching mechanism on the divider shown in FIGS. 12 and 13.

Multiple pusher subassemblies 30 will typically be attached between front mounting strip 12 and rear mounting strip 22. As with the prior art version shown in FIGS. 1 and 2, the representative embodiment of this invention includes dividers 70 located between adjacent pusher subassemblies 30 and on opposite sides of each pusher subassembly 30. The dividers 70 therefore define the sides of the rearwardly extending rows of articles 2 stacked on the same shelf. The structure of these dividers 70 used in the current embodiment is shown in more detail in FIGS. 12–15. In the preferred embodiment, each divider 70 is injection molded. The divider 70 includes a flat divider wall 80 extending above a lip 82, which extends on opposite sides of the divider wall 80 at the lower end of the divider 70. The front divider end 72 includes a vertically extending front divider tab or projection 74, which has substantially the same shape as the front track tab 46. A clearance is located adjacent to front divider tab 74 to provide space for insertion of the front divider tab 74 into the vertical front slot 14 in the front mounting strip 12 in substantially the same manner as the front track tab 46 is inserted into slot 14. The primary rear latching mechanism 86, located at the rear divider end 76 has substantially the same construction as the rear latching mechanism on the track 34. A rear tab or projection 78 is generally horizontal for insertion into the horizontal rear slot 24 on the rear mounting strip 22. This rear tab 78 is offset from the lower edge of the divider 70 to provide clearance for insertion into the offset slot 24. Divider 70 also includes a secondary rear latching mechanism 88, which is located intermediate the ends of the divider 70. This secondary latching mechanism is located at substantially the same relative longitudinal position as the cut-out 52 on the track 34. A notched or weakened section 96 extends upwardly in the divider wall 80 along the rear of this secondary rear latching mechanism 88. This weakened section 96 has a reduced thickness and extends from the divider cut-out section 90 at the lower divider edge 84 to the top of the divider wall 80. This notch 96 forms a weakened area where the divider can be severed, detaching a rear wall section 98 from the remainder of the divider 70. When the rear section 98 is detached, the secondary latching mechanism 88 will be located at the rear of the shorter divider 70, which can then be used with the shortened pusher track 34 to form the shorter version of the adjustable modular pusher system. The secondary latching mechanism 88 is formed by a cut-out section 90, which defines a secondary tab 92, which is generally collinear with the majority of the divider lower lip 82. The cut-out section 90 provides clearance so that the secondary tab can be inserted into slot 24 in rear mounting strip 22. As can best be seen in FIG. 13, the elevation of the secondary tab 92 remains below the elevation of primary rear tab 78 so that secondary tab 94 will not fit in the slot 24 in precisely the same manner as primary rear tab 78. The divider 70 will be canted from the rear toward the front when the shortened divider is attached to the two mounting strips 12 and 22. The canted configuration will not however interfere with the articles stacked in the smaller version of the modular pusher system 10. The secondary rear tab 92 includes a radiused protrusion 94 which will fit between the rear slot fingers 25 in much the same manner as those on the primary rear tab 78.

The adjustable modular pusher system 10 can be assembled in at least two ways. In the preferred method of assembling the longer version, the longer tracks 34 and dividers 70 are first snapped into the mounting strips 12 and 22 in chosen lateral positions to provide space for the desired product width between dividers 70. Since the tracks 34 and dividers 70 can be assembled at virtually any lateral position, the assembly can be adjusted to fit products of different sizes. After preassembling the tracks 34 and dividers 70 to the mounting strips 12 and 22, the backing covering the adhesive on the bottom of the mounting strips 12 and 22 is removed and the assembly is adhesively secured to the shelf. Of course the shorter version can be assembled in the same manner by detaching the rear portion of the longer tracks 34 and dividers 70 before preassembling them to the mounting strips 12 and 22. Alternatively the adjustable modular pusher system 10 can be assembled in either of its configurations by first mounting the two mounting strips 12 and 22 on a shelf with their separation equal to the length of either the longer tracks 34 and dividers 70 or to the shorter versions of these two components. For either version the pusher subassembly 30 and the dividers 70 can then be attached to the mounting strips 12 and 22 by first inserting the corresponding rearmost tabs into the horizontal slot 24. The tracks 34 and the dividers 70 would then be rotated toward the front mounting strip where the front tabs 46 and 74 are inserted into the upwardly open slot 14. Both the tracks 34 and the dividers 70 can be flexed if necessary to start the front tabs 46 and 74 in alignment with the slot 14. Regardless of the order of the assembly steps, the track subassemblies 30 and the dividers 70 can be positioned at any position along the continuous front and rear mounting strips 12 and 22 to form different rows having different widths to accommodate articles of different sizes. In this manner, the same basic components can be used to construct a wide variety of modular pusher systems, each corresponding to the requirements of given retail or other storage situations.

This system also allows the user to reduce the depth of a previously installed longer version of the assembly by merely snapping off the rear sections of the longer tracks 34 and dividers 70. Although in at least some cases it may not be possible or convenient to reattach the rear mounting strip 22 at an appropriate depth for insertion of the rear ends of shortened tracks 34 and dividers 70 into the rear mounting strips, this modular track assembly will nevertheless still adequately function in many applications, even if the rear ends of tracks 34 and 70 are not secured.

Figure 1:
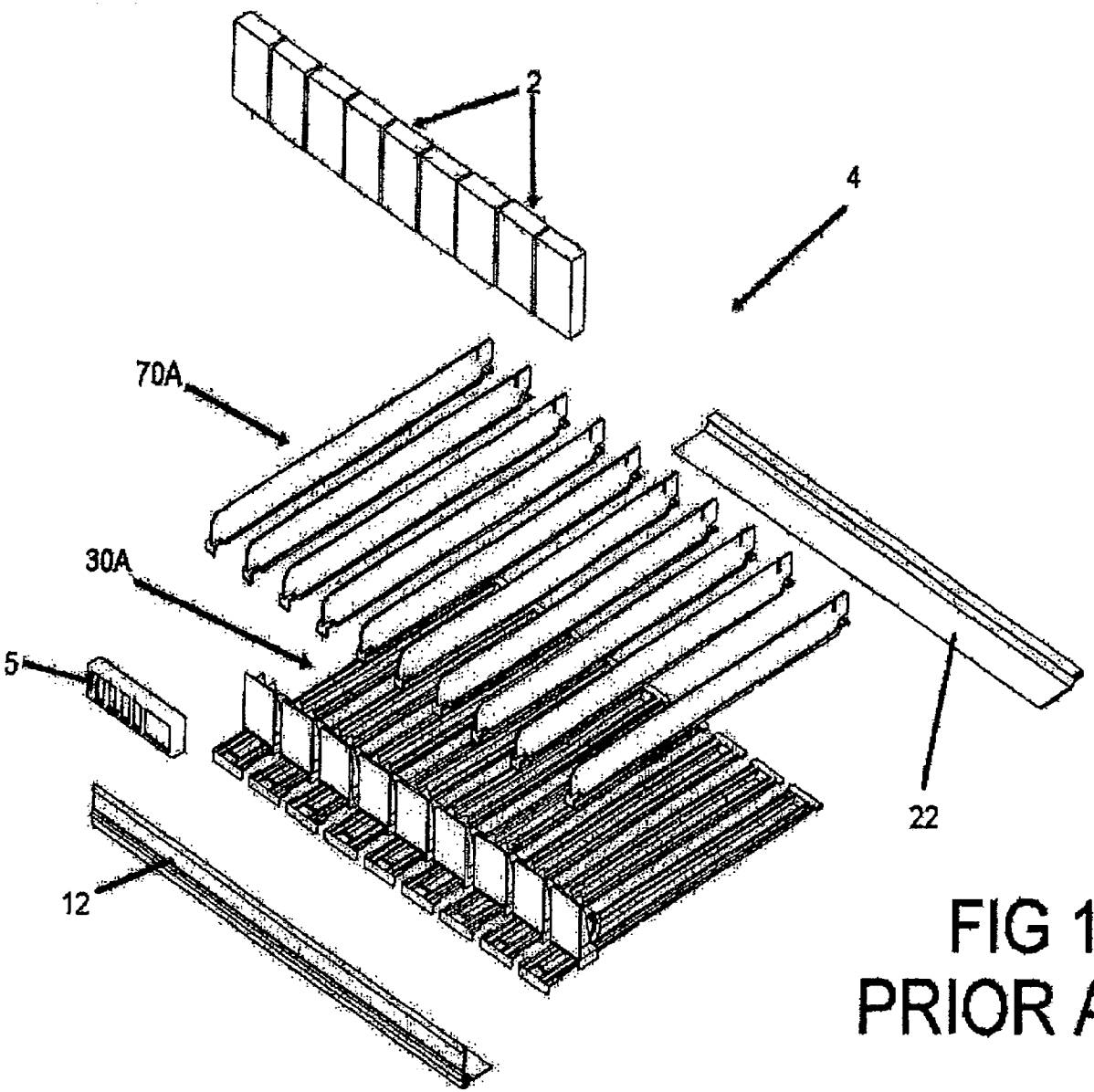
FIG 1 PRIOR ART
FIG. 1 is an exploded view showing the components of a prior art modular pusher assembly. A number of the standard components of this prior art assembly are substantially unchanged in the current invention.
Figure 2:
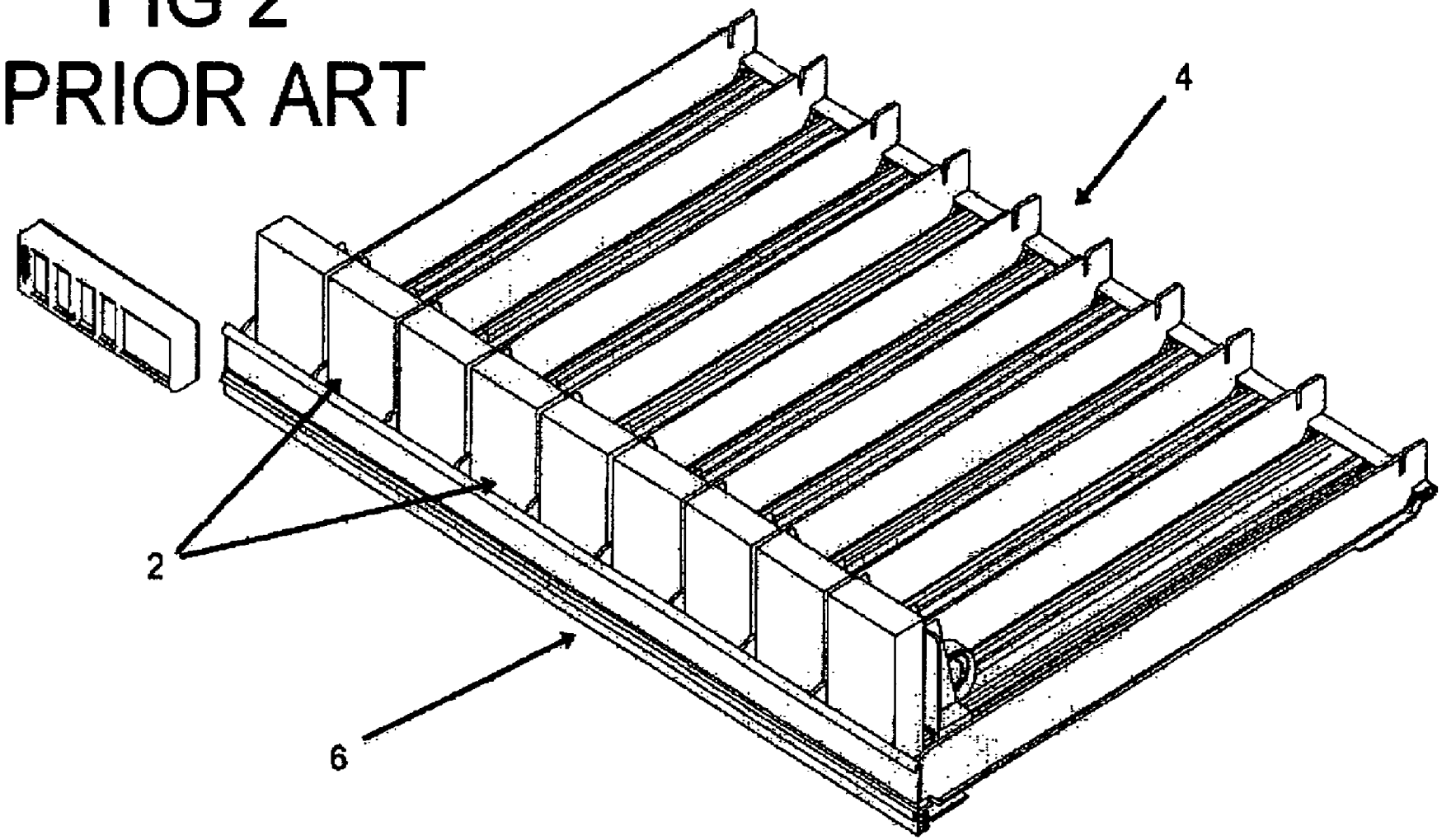
FIG 2 PRIOR ART
FIG. 2 is another view showing the components of FIG. 1 in their assembled configuration. Although the articles of merchandise displayed for sale are positioned side by side, it should be understood that multiple articles would normally be stacked in each row.

The ability to adjust the length of the modular pusher system in this manner has been accomplished without sacrificing desirable features of the prior art configuration shown in FIGS. 1 and 2. For example, the prior art configuration allows multiple pusher subassemblies 30 between adjacent dividers 70. In other words it is possible to gang pushers if desired. When a relatively long product is employed, with correspondingly large separation between dividers 70, it may be necessary or desirable to employ two pushers to evenly advance the relatively long product so that it will not become cocked or trapped. Similarly a relatively heavy product may also require spring force that can only be achieved by employing multiple side-by-side pusher subassemblies to advance heavier products. Both the prior art configuration shown in FIGS. 1 and 2, and the adjustable version according to the present invention retain this and other mutual capabilities.

I claim:

1. A modular pusher system for use with articles of merchandise located on a shelf, the system comprising:

a front member mountable on the shelf;

a rear member mountable on the shelf in spaced relationship to the front member;

at least one pusher subassembly including a pusher support slidable along a pusher track, the pusher track, attachable to and separate from the front and rear members, and extending between the front and rear member when attached thereto at opposite ends of the pusher track;

at least one divider adjacent one side of each pusher subassembly, each divider being separate from and attachable to the front and rear members at front and rear ends of each divider, the divider also being separate from the pusher track, wherein each divider includes a primary latching mechanism on the rear end thereof matable with the rear member, and at least one secondary latching mechanism located intermediate the front and rear ends of each divider, the secondary latching mechanism being attachable to the rear member when a portion of the divider between the secondary latching mechanism and the rear end of the divider is detached from the divider, so that the system can be employed for article displays having different depths.

2. The modular pusher system of claim 1 wherein the pusher track includes a cut-out located intermediate front and rear ends of the pusher track, the cut-out being located at a longitudinal position corresponding to the location of the secondary latching mechanism on the divider and notches extending partially through each pusher track, the notches comprising means for separating a rear portion of the pusher track from a forward portion of the pusher track.

3. The modular pusher system of claim 2 wherein the cut-out is formed in a groove located between parallel side rails on the pusher track.

4. The nodular pusher system of claim 3 wherein a remaining section of each rail extends rearwardly beyond the groove when a rear portion of the pusher track is removed so that the remaining rail sections can be mated in a slot on the rear member.

5. The modular pusher system of claim 1 wherein the secondary latching member on the divider is located on a lower edge of the divider, the primary latching mechanism on the rear end of the divider being offset from the lower edge of the divider.

6. The modular pusher system of claim 5 wherein a lip extends along the lower edge of the divider and a portion of the secondary latching mechanism is formed in the lip.

7. The modular pusher system of claim 6 wherein the secondary latching mechanism also includes a raised surface extending above the lip.

8. The modular pusher system of claim 1 wherein a portion of the secondary latching mechanism is formed by a cut out section in the divider.

9. The modular pusher system of claim 1 wherein the divider is sloped at an angle relative to the shelf when the secondary latching mechanism is attached to the rear member.

10. The modular pusher system of claim 1 included a plurality of pusher subassemblies and a plurality of dividers, each divider being separate from adjacent pusher subassemblies, dividers being located on opposite sides of each pusher subassembly, the dividers and pusher subassemblies being laterally adjustable so that articles having different sizes can be displayed on the same shelf.

11. A pusher apparatus for advancing articles of merchandise stacked in a row on a shelf as articles at the front of the row are sequentially removed so that articles are always located at the front of a shelf for removal by prospective purchasers, the pusher apparatus comprising:

a one piece molded track including rails flanking a groove extending from a front end to a rear end of the track, the track including a front projection and a rear projection, the front and rear projections comprising means for snapping the molded track into engagement with mounting members mountable on the shelf;

a pusher support slidable along the track comprising upright means for engaging the rear article of merchandise, wherein the one-piece molded track is configured so that only a single pusher support can be mounted in sliding engagement on the track;

a coil spring attachable at opposite ends to the pusher support and to the molded track, the coil spring being positioned to urge the pusher support toward the front end of the track, wherein the one piece molded track includes a cut-out section in the groove and a notch, both located at an intermediate position between the font end and rear end of the track, the notch weakening the track at the intermediate position for detachment of a portion of the track and the cut-out being positioned relative to the notch so that remaining portions of the rails extend beyond the groove when the track is broken at the notch so that the remaining rail portions comprise means for attaching the pusher apparatus on the shelf when the pusher apparatus is shortened.

12. The pusher apparatus of claim 11 wherein the notch is located adjacent a rear edge of the cut-out.

13. The pusher apparatus of claim 11 wherein the notch extends partially through the rails.

14. The pusher apparatus of claim 11 wherein a front edge of the cut-out is inclined at a greater angle than a rear edge to provide clearance for snapping the remaining rail portions to a separate rear member extending above the shelf.

15. The pusher apparatus of claim 11 wherein the rails are located along edges of the track with the rails including uppermost surfaces on the track, so that the track can be positioned at various positions on the shelf adjacent to and variably spaced relative to separate divider walls extending between adjacent pusher tracks.

* * * * *